US005178576A

United States Patent [19]

Ayers

[11] Patent Number: 5,178,576

[45] Date of Patent: Jan. 12, 1993

[54] APPARATUS AND METHOD FOR MANUPULATING A SPRING TOY

[76] Inventor: David B. Ayers, 13908 Cravenridge Dr., Houston, Tex. 77083

[21] Appl. No.: 650,163

[22] Filed: Feb. 4, 1991

[51] Int. Cl.[5] ..... A63H 33/00

[52] U.S. Cl. ..... 446/486; 446/170; 273/67 R

[58] Field of Search ..... 446/486, 170, 171, 491, 446/324, 314; 273/67 R, 109, 129 Q, 342, 317, 318, 327; 272/67

[56] References Cited

U.S. PATENT DOCUMENTS 2,415,012 1/1947 James ..... 446/486
3,047,980 8/1962 Bischoff ..... 273/109 X
4,052,067 10/1977 Carmo ..... 273/109

*Primary Examiner*—Mickey Yu
*Attorney, Agent, or Firm*—Kenneth A. Roddy

[57] ABSTRACT

A pair of platform devices used for interaction with a flexible coil spring toy have a plurality of flat step-like surfaces separated vertically and horizontally corresponding to the periodic step-walking motion of the flexible coil spring toy. The platform devices are manipulated in an alternating sequence in cooperation with the motion of the flexible coil spring toy to give the appearance that the toy is walking down a set of stairs. In the preferred embodiment, the platform devices have a handle and are held and manipulated by a human operator. The spring momentum transfers the coils of the spring from one surface of the device to the next lowermost surface of the device as the spring's adjacent coils successively sweep through the path of an arc. When a certain amount of coils have been moved to the lower surface, the momentum causes the trailing coils to move over the center of mass of the flexible coil spring and land onto another lower surface to give the appearance that the flexible coil spring toy is walking down a set of stairs. When the spring toy reaches the lowermost surface of one of the devices, the other device is placed in position to enable the spring toy to land on its uppermost surface. The manipulation of the devices is continued to repeatedly transfer the spring toy from one device to the other for amusement.

14 Claims, 2 Drawing Sheets

APPARATUS AND METHOD FOR MANUPULATING A SPRING TOY

BACKGROUND OF THE INVENTION

1. Field of the Invention

This invention relates generally to amusement devices, and more particularly to a pair of platform devices having step-like surfaces which are manipulated in alternating sequence in cooperation with a flexible coil spring toy to transfer the coils of the flexible coil spring toy in a motion descending successively-presented step-like surfaces and give the appearance that the toy is walking down a set of stairs.

2. Brief Description of the Prior Art

Amusement devices employing a flexible coil spring toy device are known in the art. There are several patents which disclose various apparatus used in combination with flexible coil spring devices. None of these patents disclose an amusement device auxiliary to the flexible coil spring toy which provides a human operator with a test of skill to maintain the flexible coil spring toy in motion.

James, U.S. Pat. No. 2,415,012 discloses a flexible coil helical spring toy adapted to walk and oscillate. The patent is directed toward a spring structure having substantially no lateral force between turns in closed position when no external force is acting. In the rest position, each coil contacts an adjacent one. The spring cross section is of a shape which has essentially lower torsional stiffness for a given cross sectional area than a square to produce a low natural frequency. There is no suggestion of a platform device moved synchronous to the spring action for manipulating the spring toy.

Sabo, U.S. Pat. No. 2,854,786 discloses an amusement device employing a flexible coil spring having a plurality of balls therein and end plates at each end. A frame having a pivotal parallelogram linkage moves the end plates in alternating elevational relation to transfer the major portion of the spring and balls from one end to the other.

Bischoff, U.S. Pat. No. 3,047,980 discloses a circular board which is rockable and rotatable and a playing piece comprising a pair of eccentrically weighted flat bottom members arranged in side-by-side relation and joined by a coil spring member which moves about in a random manner on the board when it is rocked.

Tarow et al, U.S. Pat. No. 4,828,532 discloses a motorized coil spring amusement device including a housing containing a motor with a track driven by the motor having dwell and flat portions on which a pair of spaced rollers roll. A shaft connects each roller to a plate. A coil spring is affixed at each end to each plate. As the track is rotated, the plates are raised and lowered, causing the coils of the spring to be moved back and forth between the plates.

The present invention is distinguished over the prior art in general, and these patents in particular by a pair of platform devices used for interaction with a flexible coil spring toy which have a plurality of flat step-like surfaces separated vertically and horizontally corresponding to the periodic step-walking motion of the flexible coil spring toy. The platform devices are manipulated in an alternating sequence in cooperation with the motion of the flexible coil spring toy to give the appearance that the toy is walking down a set of stairs. In the preferred embodiment, the platform devices have a handle and are held and manipulated by a human operator. The spring momentum transfers the coils of the spring from one surface of the device to the next lowermost surface of the device as the spring's adjacent coils successively sweep through the path of an arc. When a certain amount of coils have been moved to the lower surface, the momentum causes the trailing coils to move over the center of mass of the flexible coil spring and land onto another lower surface to give the appearance that the flexible coil spring toy is walking down a set of stairs. When the spring toy reaches the lowermost surface of one of the devices, the other device is placed in position to enable the spring toy to land on its uppermost surface. The manipulation of the devices is continued to repeatedly transfer the spring toy from one device to the other for amusement.

SUMMARY OF THE INVENTION

It is therefore an object of the present invention to provide an amusement device wherein a flexible coil spring toy is maintained in a motion to descend a plurality of step-like surfaces.

It is another object of this invention to provide a platform device having step-like surfaces which is manipulated by a human operator to begin and end the step descending motion of a flexible coil spring toy in an enjoyable and entertaining manner.

Another object of this invention to provide an amusement device wherein a pair of hand-held platform devices are manipulated by a human operator in an alternating sequence to maintain a step descending motion of a flexible coil spring toy.

Another object of this invention to provide a method for manipulating a flexible coil spring toy wherein a pair of hand-held devices having step-like surfaces are manipulated by a human operator in an alternating sequence to maintain a step descending motion of a flexible coil spring toy.

A further object of this invention is to provide an amusement device which requires skill of a human operator to physically manipulate and control a pair of hand-held platform devices to begin, maintain, and end, a step descending motion of a flexible coil spring toy.

A still further object of this invention is to provide a hand-held platform device used in cooperation with a flexible coil spring toy which is simple in construction, economical to manufacture, and safe in operation.

Other objects of the invention will become apparent from time to time throughout the specification and claims as hereinafter related.

The above noted objects and other objects of the invention are accomplished by a pair of platform devices used for interaction with a flexible coil spring toy which have a plurality of flat step-like surfaces separated vertically and horizontally corresponding to the periodic step-walking motion of the flexible coil spring toy. The platform devices are manipulated in an alternating sequence in cooperation with the motion of the flexible coil spring toy to give the appearance that the toy is walking down a set of stairs. In the preferred embodiment, the platform devices have a handle and are held and manipulated by a human operator. The spring momentum transfers the coils of the spring from one surface of the device to the next lowermost surface of the device as the spring's adjacent coils successively sweep through the path of an arc. When a certain amount of coils have been moved to the lower surface, the momentum causes the trailing coils to move over the center of mass of the flexible coil spring and land onto another lower surface to give the appearance that the flexible coil spring toy is walking down a set of stairs. When the spring toy reaches the lowermost surface of one of the devices, the other device is placed in position to enable the spring toy to land on its uppermost surface. The manipulation of the devices is continued to repeatedly transfer the spring toy from one device to the other for amusement.

DESCRIPTION OF THE PREFERRED EMBODIMENT

Figure 1:
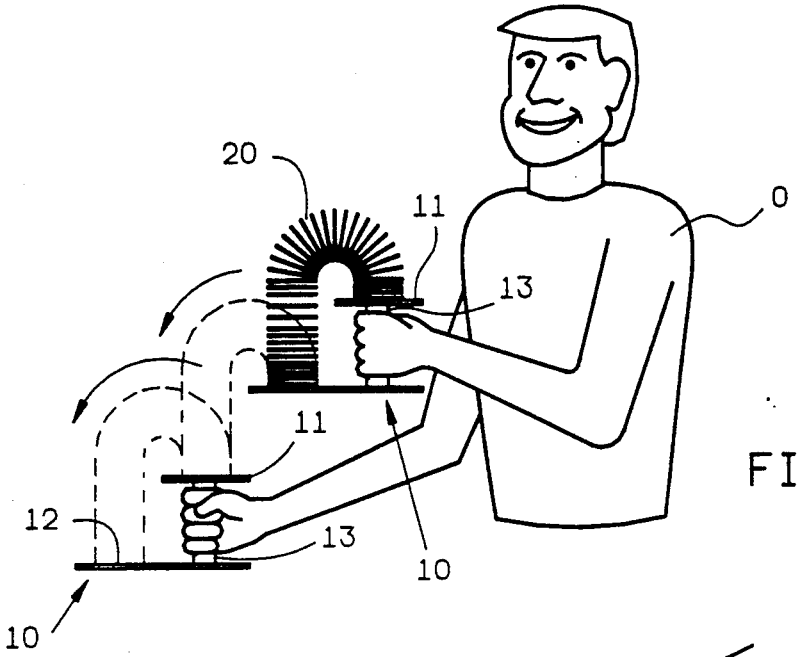
FIG. 1 is a side view showing a pair of hand-held platform devices in accordance with the present invention being manipulated by an operator to transfer the coils of a flexible coil spring toy in a motion to give the appearance that the toy is walking down a set of stairs.

Referring to the drawings by numerals of reference, there is shown in FIG. 1, a pair of hand-held platform devices 10 having step-like surfaces which are manipulated by a human operator 0 in alternating sequence in cooperation with a flexible coil spring toy 20 to transfer the coils of the flexible coil spring toy in a motion descending successively-presented step-like surfaces and give the appearance that the toy is walking down a set of stairs.

A preferred flexible coil spring toy 20 is of the type known commercially as a "Slinky" (TM) manufactured by James Industries. The spring characteristics being a helical spring having substantially no lateral force between turns in closed position when no external force is acting. In the rest position, each coil contacts an adjacent one. The spring cross section is of a shape which has essentially lower torsional stiffness for a given cross sectional area than a square. Such a spring has a low natural frequency (between 10 and 100 cycles per minute) and provides an amusing toy having the ability to "walk" and "oscillate".

Figure 2:
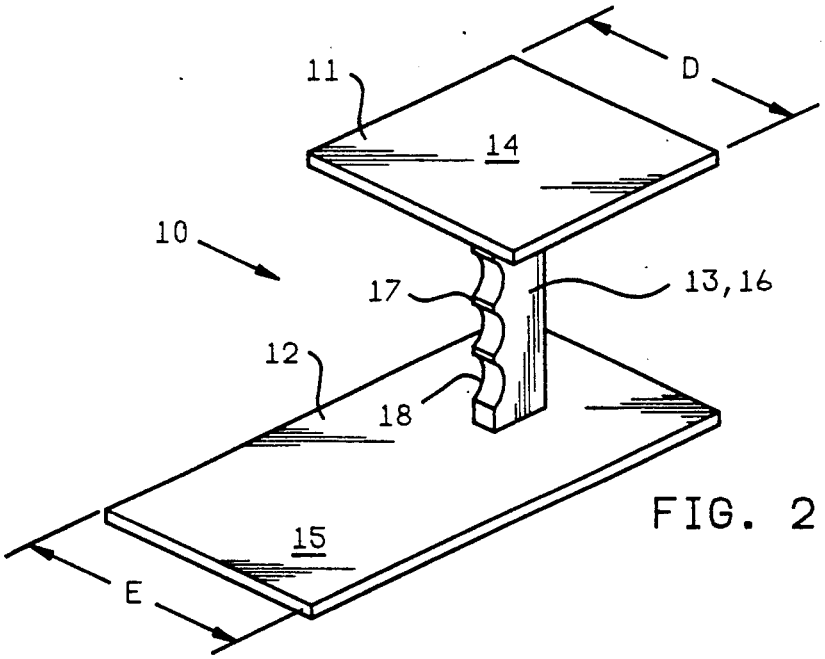
FIG. 2 is an isometric view of one of the hand-held platform devices in accordance with the present invention.
Figure 3:
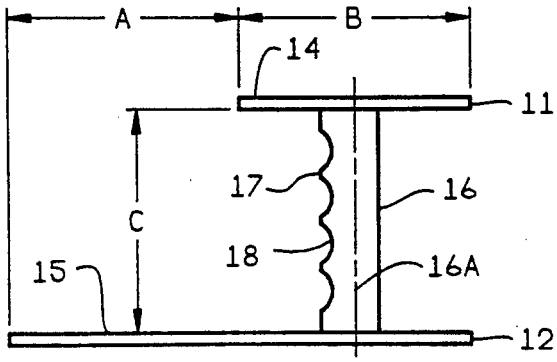
FIG. 3 is a side elevation of the hand-held platform device of FIG. 2.

As best seen in FIGS. 2 and 3, each platform device 10 has a flat generally square upper plate 11 and a flat, generally rectangular lower plate 12 joined together in vertically spaced, parallel relation by a vertical connecting member 13. The upper and lower plates 11, 12 and the connecting member 13 are made of a suitable rigid material, such as plastic or wood.

The vertical connecting member 13 extends from the bottom surface of the upper plate 11 to the top surface of the lower plate 12. The top surface 14 of the upper plate 11 and the top surface 15 of the lower plate 12 are parallel to one another and separated by a vertical distance C (FIG. 3).

In the preferred embodiment, the platform devices are described as being manipulated by a human operator, however, it should be understood that the vertical connecting member 13 of one or more devices may be connected to mechanical manipulating apparatus driven by a motor as described hereinafter.

In the preferred embodiment, the vertical connecting member 13 is in the form of a handle 16 having ridges 17 and recesses 18 to facilitate an improved grip for the hand of the human operator 0. The handle 16 is disposed vertically between the upper plate 11 and the lower plate 12 with the longitudinal axis 16A of the handle passing through the center of the upper plate 11 (FIG. 3).

The rectangular lower plate 12 extends beyond the end of the upper plate 11 a distance A. Because it is possible to manufacture a flexible coil spring toy 20 in various sizes, the distance C between the upper plate top surface 14 and the lower plate top surface 15 is sufficient to correspond to the periodic step-walking motion of the flexible coil spring toy 20 of a particular size. The length B and the width D of the upper plate should each be larger than the outer diameter J of the flexible coil spring toy 20 (FIG. 7) such that it will fit stabily on the upper plate 11. The exposed length A and width E of the lower plate 12 should each be larger than the outer diameter J of the flexible coil spring toy 20 for the same reason. Lengths A and B are preferably substantially equal.

Although a preferred embodiment has the upper and lower plates 11 and 12 extending in the same plane, it should be understood that the lower plate or several lower plates may be provided to extend in a radially offset or spiral pattern. In other words, the plates may be arranged to form spirally descending step-like surfaces.

The top surface 14 of the upper plate 11 and the top surface 15 of the lower plate may be formed of suitable material, or material may be applied to the top surfaces, to provide a desired coefficient of friction to prevent the flexible coil spring toy from slipping and provide improved control of the toy.

Figure 7:
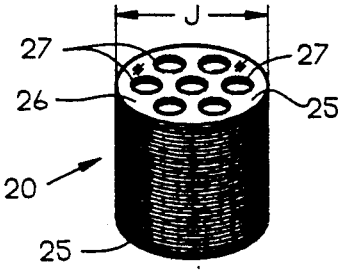
FIG. 7 is an isometric view of a modified flexible coil spring toy having disks at each end to facilitate interaction with the surfaces of the hand-held platform device.

As shown in FIG. 7, the flexible coil spring toy 20 may be modified by attaching a flat disk 25 to each end of the coil spring by adhesive or other suitable methods. The disk 25 or its outer surface 26 may also be formed of suitable material to provide a desired coefficient of friction. The effective surface area of the disk 25 may also be modified by providing a plurality of holes 27 through the surface. By controlling the coefficient of friction of these surfaces, and/or the effective surface area of the disks 25, the level of difficulty of operating the devices 10 to cause the descending motion can be controlled. Also, by attaching these disks, additional mass is added to effect the motion of the flexible coil spring toy.

Figure 4:
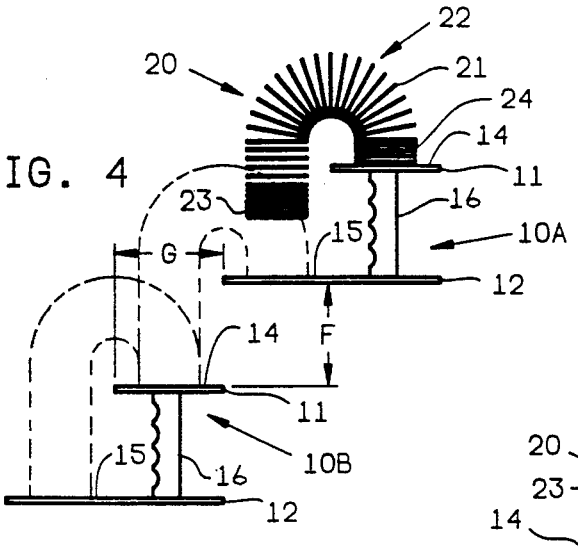
FIG. 4 is a side elevation of a pair of the hand-held platform devices being used in cooperation with a flexible coil spring toy.

FIG. 4 shows a pair (10A and 10B) of the platform devices 10 being used in cooperation with a flexible coil spring toy 20. The desired path of motion of the flexible coil spring toy 20 is a descending arc as shown by phantom lines. As the spring's adjacent coils successively sweep through the path of the arc, a certain amount of coils will be moved to the lower surface and the momentum causes the trailing coils to move over the center of mass of the flexible coil spring and land onto another lower surface.

OPERATION

Referring again to FIGS. 3 and 4, a description of a convenient method to begin the operation of the flexible coil spring toy 20 in descending motion follows. The flexible coil spring toy 20 is placed onto the upper plate 11 of the device held uppermost by the operator. The uppermost device 10A is positioned relative to the lowermost device 10B by the distances F and G.

The distance F represents the vertical distance from the top surface 15 of the lower plate 12 of the uppermost device 10A to the top surface 14 of the upper plate 11 of the lowermost device 10B. The distance G represents the horizontal distance from the front of the lower plate 12 of the uppermost device 10A to the front of the upper plate 11 of the lowermost device 10B. For best results of step-descending motion of the flexible coil spring toy 20, the distance F should be made generally equal to C and the distance G should be made generally equal to the distance A.

The descending motion of the flexible coil spring toy 20 can be initiated several ways. If the operator is alone, both devices 10 are placed on a flat surface and the flexible coil spring toy 20 is placed on the upper plate 11 of one device. The upper portion of the flexible coil spring toy 20 is then pulled over in an arc and allowed to drop onto the lower plate 12. As the coils of the toy 20 are moving to the lower plate 12, both devices are picked up by the operator. The device 10 on which the toy 20 is placed is held higher than the other device, or in the uppermost position described above and the other device is held in the lowermost position.

Another way of initiating the descending motion is for the operator to hold the devices 10A and 10B in the uppermost and lowermost positions and have another person place the flexible coil spring toy 20 on the upper plate 11 of the uppermost device 10A. The other person then pulls the upper portion of the flexible coil spring toy 20 over in an arc to initiate the descending motion.

As soon as the flexible coil spring toy 20 has left the uppermost device 10A, the lowermost device 10B is moved upwardly and backwardly into the original position occupied by the uppermost device 10A while the uppermost device 10A is moved downwardly and forwardly into the original position occupied by the lowermost device 10B. If this transfer of position of the uppermost and lowermost devices 10A and 10B is accomplished synchronous to the descending motion of the flexible coil spring toy 20, the descending motion can continue without interruption.

Figure 5:
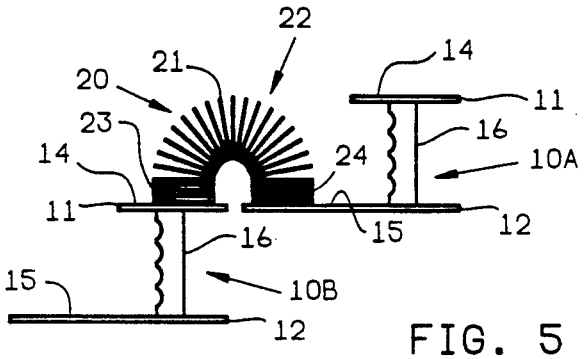
FIG. 5 is a side elevation of a pair of the hand-held platform devices with a flexible coil spring toy shown in an intermediate resting position.

During the manipulation of the devices 10 in cooperation with the descending motion of the flexible coil spring toy 20, it is possible to modify the descending motion by varying the vertical distance F between the upper and lower devices 10A and 10B. If the vertical distance F is decreased, the flexible coil spring toy 20 can be made to slow its transfer of coils 21 between the devices. As shown in FIG. 5, if the vertical distance F is made equal to zero, the flexible coil spring toy 20 will stop its motion and come to rest. This resting position causes the flexible coil spring toy 20 to assume a semi-circular arc configuration with a fan-like section 22 of coils 21 located between a leading pile 23 of coils and a trailing pile 24 of coils. The descending motion of the flexible coil spring toy 20 can be again initiated by lifting the uppermost device 10A.

If the vertical distance F is increased greater than distance C, the coils 21 of the flexible coil spring toy 20 will spread farther apart during its descent from the uppermost device 10A to the lowermost device 10B.

Figure 6A:
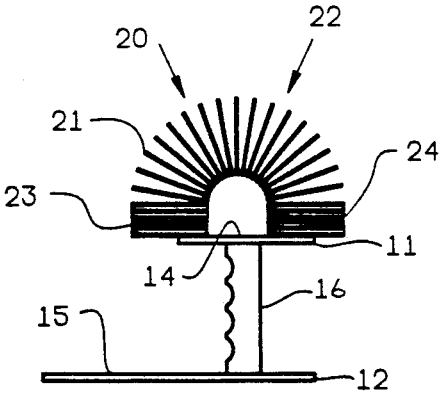
FIG. 6A is a side elevation of one of the hand-held platform devices with a flexible coil spring toy shown in a position to initiate the descending motion.
Figure 6B:
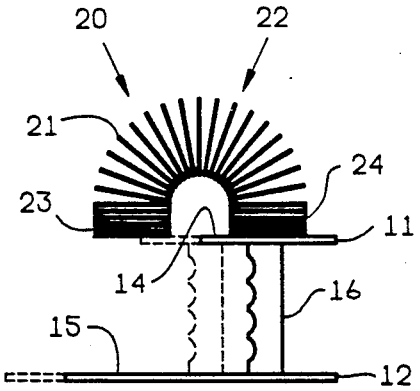
FIG. 6B is a side elevation of one of the hand-held platform devices with a flexible coil spring toy shown immediately after a sudden horizontal movement of the hand-held platform device.

Referring now to FIGS. 6A and 6B, another convenient method of initiating the descending motion of the flexible coil spring toy 20 is described. The flexible coil spring toy 20 is placed on the upper plate 11 of the uppermost device 10A in a resting position opened to form a semi-circular arc configuration with a fan-like section 22 of coils 21 located between a leading pile 23 of coils and a trailing pile 24 of coils (FIG. 6A). The leading pile 23 is placed across the front edge on the upper plate 11 to a distance of approximately one-half the diameter of the J of the flexible coil spring toy 20. The uppermost device 10A is then moved quickly backward so that the inertia of the flexible coil spring toy 20 causes it to tend to remain in its resting position. FIG. 6B shows the position of the flexible coil spring toy 20 relative to the uppermost device 10A for the instant after the backward movement is complete. Now the leading pile 23 of coils 21 will drop onto the lower plate 12 and the descending motion will begin.

In the preferred embodiment, the platform devices are described as being manipulated by a human operator, however, it should be understood that the vertical connecting member 13 of one or more devices may be connected to a mechanical linkage which is driven by a motor. The mechanical linkage would manipulate the platform devices to position the uppermost device relative to the lowermost device by the distances F and G described above synchronous to the descending motion of the flexible coil spring toy 20. The flexible coil spring toy 20 is placed on the upper plate 11 of one device and its descending motion is initiated to transfer the coils from the upper plate to the lower plate of the uppermost device. As the coil spring toy 20 leaves the lower plate of the uppermost device, the mechanical linkage apparatus would move the lowermost device upwardly and backwardly into the original position occupied by the uppermost device while simultaneously moving the uppermost device downwardly and forwardly into the original position occupied by the lowermost device.

While this invention has been described fully and completely with special emphasis upon a preferred embodiment, it should be understood that within the scope of the appended claims the invention may be practiced otherwise than as specifically described herein.

I claim:

1. A manually manipulated platform amusement device for use in cooperation with an existing flexible coil helical spring toy of the type capable of transferring its coils in an arcuate end-over-end step-like waling motion, the platform amusement device comprising;

a first and second manually manipulative platform device each having a plurality of flat step-like surfaces spaced vertically and horizontally relative to one another corresponding to the periodic step-walking motion of the coils of the flexible coil spring toy to form a descending path for the toy, and each said platform device configured to be manually manipulated relative to one another in an alternating sequence in cooperation with the coils of the flexible coil spring toy to transfer the coils of the flexible coil spring toy in a motion descending successively-presented step-like surfaces to give the appearance that the flexible coil spring toy is walking down an endless set of stairs.

2. A platform amusement device according to claim 1 in which said flat step-like surfaces comprise a plurality of rigid flat plate members connected in vertically spaced relation to form at least one upper and and one lower plate member.

3. A platform amusement device according to claim 2 in which said rigid flat plate members comprise a generally square upper plate and a generally rectangular lower plate, said upper plate and said lower plate disposed in vertically spaced parallel relation.

4. A platform amusement device according to claim 3 in which the top surface of said upper plate and the top surface of said lower plate are parallel to one another and separated by a vertical distance corresponding to the periodic step-walking motion of the coils of the existing flexible coil spring toy.

5. A platform amusement device according to claim 4 in which said rectangular lower plate member extends beyond the end of said upper plate member by a horizontal distance corresponding to the periodic step-walking motion of the coils of the existing flexible coil spring toy, and the length and width of said upper plate and the length and width of said lower plate extended portion are larger than the outer diameter of the coils of the existing flexible coil spring toy.

6. A platform amusement device according to claim 1 in which the top surface of said flat step-like surfaces are comprised of material having a coefficient of friction sufficient to substantially prevent the flexible coil spring toy from slipping and provide improved control of the motion of the flexible coil spring toy in its descending motion.

7. A platform amusement device according to claim 1 including a flat disk configured to be installed on the coils at each end of the existing flexible coil spring toy and each said disk having a plurality of holes through its surface to provide an effective surface area to facilitate engagement with said flat step-like surfaces in its descending motion, each said disk comprised of material having a coefficient of friction sufficient to substantially prevent the flexible coil spring toy from slipping and provide improved control of the motion of the flexible coil spring toy, and each said disk having a sufficient mass to provide improved control of the motion of the flexible coil spring toy and facilitate the descending motion of the flexible coil spring toy.

8. A platform amusement device according to claim 1 in which;

each said platform device having hand grip means connected with said step-like surfaces for receiving the hand of a human operator, and each said platform device is gripped and manually manipulated by a human operator in cooperation with the coils of the flexible coil spring toy to transfer the coils of the flexible coil spring toy in a motion descending successive said step-like surfaces to give the appearance that the flexible coil spring toy is walking down a set of stairs.

9. A hand-held amusement device comprising;

a first and second manually manipulative hand-held platform device each having hand grip means for receiving the hand of a human operator and a plurality of flat step-like surfaces connected with said hand grip means and spaced vertically and horizontally relative to one another to form a descending path, and a flexible coil helical spring toy having substantially no lateral force between turns in closed position when no external force is acting, in which in the position of rest each coil contacts an adjacent one, in which the spring cross section is of a shape which has essentially lower torsional stiffness for a given cross sectional area than a square to produce a low natural frequency, each said platform device being gripped and manually manipulated relative to one another in an alternating sequence by a human operator in cooperation with the coils of said flexible coil spring toy to transfer the coils of the flexible coil spring toy in an arcuate end-over-end motion descending successively-presented step-like surfaces to give the appearance that the flexible coil spring toy is walking down an endless set of stairs.

10. A hand-held amusement device according to claim 9 in which said flat step-like surfaces comprise a plurality of rigid flat plate members connected in vertically spaced relation and separated by a vertical distance corresponding to the periodic step-walking motion of said flexible coil spring toy.

11. A hand-held amusement device according to claim 10 in which said rigid flat plate members comprise a generally square upper plate and a generally rectangular lower plate disposed in vertically spaced parallel relation, said rectangular lower plate member extends beyond the end of said upper plate member by a horizontal distance corresponding to the periodic step-walking motion of said flexible coil spring toy, and the length and width of said upper plate and the length and width of said lower plate extended portion are larger than the outer diameter of said flexible coil spring toy.

12. A hand-held amusement device according to claim 9 in which the top surface of said step-like surfaces are comprised of material having a coefficient of friction sufficient to substantially prevent said flexible coil spring toy from slipping and provide improved control of the motion of said flexible coil spring toy in its descending motion.

13. A hand-held amusement device according to claim 9 including a flat disk installed on the coils at each end of said flexible coil spring toy and each said disk having a plurality of holes through its surface to provide an effective surface area to facilitate engagement with said step-like surfaces in its descending motion, said disk comprised of material having a coefficient of friction sufficient to substantially prevent said flexible coil spring toy from slipping and having a sufficient mass to provide improved control of the motion of said flexible coil spring toy.

14. A method of manipulating a flexible coil spring toy to simulate the movement of the toy walking down a set of stairs comprising the steps of;

providing a flexible coil helical spring toy having substantially no lateral force between turns in closed position when no external force is acting, in which in the position of rest each coil contacts an adjacent one, in which the spring cross section is of a shape which has essentially lower torsional stiffness for a given cross sectional area than a square to produce a low natural frequency, providing a pair of platform devices having a plurality of step-like surfaces positioned vertically and horizontally relative to one another corresponding to the periodic step-walking motion of the flexible coil spring toy to form a descending path for the toy, each platform device having manipulating means for moving same in cooperation with the flexible coil spring toy to present successive step-like surfaces, manipulating one said platform device in cooperation with said flexible coil spring toy to transfer the coils of the flexible coil spring toy in a motion descending successive said step-like surfaces to give the appearance that the flexible coil spring toy is walking down a set of stairs, and upon said flexible spring toy reaching the lowermost surface of said one of the device,, manipulating the other said device into a position to receive said flexible spring toy on its uppermost step-like surface, and thereafter alternating the position of said devices to continue the descending motion.

* * * * *